United States Patent [19]

Yoshino

[11] Patent Number: 4,838,960

[45] Date of Patent: Jun. 13, 1989

[54] METHOD OF MANUFACTURING MARTENSITIC STAINLESS STEEL EXCELLENT IN RESISTANCE TO STRESS CORROSION CRACKING

[75] Inventor: Yuichi Yoshino, Fuchu, Japan

[73] Assignee: The Japan Steel Works, Ltd., Tokyo, Japan

[21] Appl. No.: 210,513

[22] PCT Filed: Oct. 24, 1986

[86] PCT No.: PCT/JP86/00537

§ 371 Date: Jun. 17, 1988

§ 102(e) Date: Jun. 17, 1988

[87] PCT Pub. No.: WO88/03176

PCT Pub. Date: May 5, 1988

[51] Int. Cl.[4] ..... C21D 6/00

[52] U.S. Cl. ..... 148/135; 148/325

[58] Field of Search ..... 148/135, 325; 420/34

[56] References Cited

U.S. PATENT DOCUMENTS 4,218,268 8/1980 Hiroshi et al. ..... 148/135

FOREIGN PATENT DOCUMENTS 60-234953 11/1985 Japan .

*Primary Examiner*—Deborah Yee

*Attorney, Agent, or Firm*—Oblon, Spivak, McClelland, Maier & Neustadt

[57] ABSTRACT

A method of manufacturing a martensitic stainless steel which is excellent in resistance to stress corrosion cracking and which has excellent low-temperature toughness and corrosion resistance. A steel containing 2 to 6% by weight of Ni and 15 to 18% by weight of Cr is prepared. The steel is heated to and then maintained at a temperature of 680° to 830° C., followed by cooling the steel. The thus cooled steel is optionally subjected to tempering at a temperature of less than 600° C.

3 Claims, 3 Drawing Sheets

METHOD OF MANUFACTURING MARTENSITIC STAINLESS STEEL EXCELLENT IN RESISTANCE TO STRESS CORROSION CRACKING

TECHNICAL FIELD

The present invention relates to a method of manufacturing a martensitic stainless steel which is excellent in resistance to stress corrosion cracking and which has excellent corrosion resistance and low-temperature toughness.

BACKGROUND ART

Such typical Cr—Ni martensitic stainless steels as ASTMA296 296 steel and CA6NM steel are widely used in such products as valves or runners which are required to exhibit sufficient levels of strength and corrosion resistance. In recent years, CA6NM steel and forged materials based thereon have also found applications in petroleum drilling equipment. On the other hand, austenitic stainless steel has an excellent corrosion resistance but it has a high susceptibility to chloride stress corrosion cracking. Accordingly, austenitic stainless steel cannot be used in cases involving a risk of crack formation due to stress corrosion and, if such is the case, chromium-based stainless steels or high Ni alloys are usually used. In particular, 410 steel and 430 steel, which are inexpensive, are widely used in such cases.

However, the corrosion resistance of 410 steel and 430 steel is not necessarily sufficient. In addition, these types of steel are generally known to have a significant drawback, that is, their very poor low-temperature toughness. Further, since 430 steel is a type of ferritic stainless steel, it cannot be used for a member or part which is required to have a high strength.

On the other hand, a martensitic stainless steel containing a few wt % of Ni can have its strength varied within a relatively wide range by slightly adjusting its composition and altering heat treatment conditions. This stainless steel also has an advantage that it has a very excellent low-temperature toughness. Although the addition of Mo not more than 1% is done generally to this steel so as to improve its strength, toughness and corrosion resistance, it is Ni that plays an important role in improving these characteristics, i.e., strength, low-temperature toughness and general corrosion resistance. However, a problem is encountered with stainless steels in that, although the addition of Ni imparts excellent characteristics, it also increases to an extreme extent the susceptibility to stress corrosion cracking. The level of the susceptibility in a Ni-containing martensitic stainless steel corresponds to that of AISI304 steel. For this reason, the martensitic stainless steel of this type cannot enjoy as wide an application range as that of 410 steel or 430 steel, in spite of the fact that this steel is excellent in other characteristics such as strength, toughness, and resistance to general corrosion.

DISCLOSURE OF INVENTION

As discussed above, conventionally known AISI 410 steel has an excellent resistance to stress corrosion cracking but it has poor corrosion resistance and poor low-temperature toughness. The strength of AISI430 steel cannot be varied, and this steel therefore cannot be used in a member which is required to possess a high strength. On the other hand, although a martensitic stainless steel containing Ni has excellent low-temperature toughness and it has the capacity to have its strength adjusted within a wide range, this steel has a drawback in that its resistance to stress corrosion cracking is extremely low.

The objective of the present invention is to provide a method of manufacturing a martensitic stainless steel which is excellent in resistance to stress corrosion cracking, has a high level of low-temperature toughness, and allows the adjustment of its strength within a wide range, by combining the chemical composition and the heat treatment of a martensitic stainless steel containing Ni under specific conditions.

The present inventor has conducted extensive studies on possible chemical compositions and the heat treatments for martensitic stainless steels containing Ni. As a result, he has found a method in which a stainless steel having a specific composition is subjected to a specific heat treatment whereby the susceptibility to chloride stress corrosion cracking can be greatly improved. In this method, a steel containing 2 to 6% by weight of Ni and 15 to 18% by weight of Cr is heated to and then maintained at a temperature of 680° to 830° C., followed by being cooled. Another aspect of the present invention provides a method in which, after the steel has been subjected to the heating and then maintaining the temperature, followed by the cooling, it is tempered at a temperature of less than 600° C.

BEST MODE FOR CARRYING OUT THE INVENTION

Figure 1:
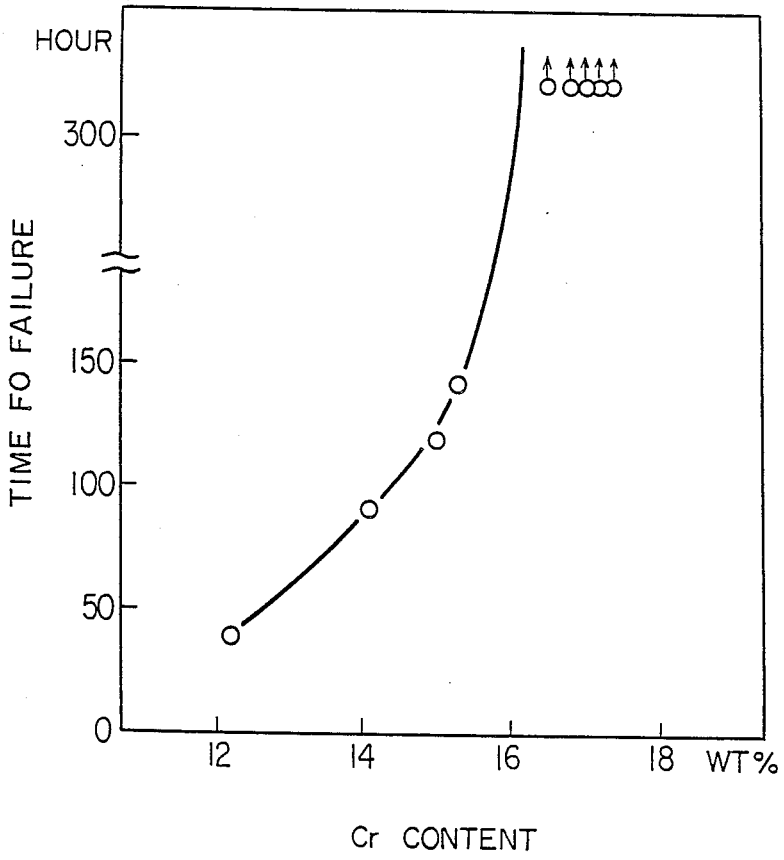
FIG. 1 is a graph showing the relationship between the time to failure and the Cr content, obtained from tests conducted, using 42%-$MgCl_2$ aqueous solutions, for steels which each contain 2 to 3% of Ni, 0.3 to 0.5% of Mo, and a varying amount of Cr, and which each have been quenched from a temperature of 680° to 710° C. and tempered at a temperature of 530° to 540° C.

Various types of Cr—Ni martensitic stainless steel have hitherto been standardized; they include ASTM A296, CA6NM, BS970: Part 4 431S29, DIN 17440 X22Cr Ni17, NF A35-581 Z712CND 16.04. Each of these types of steel contain 11.5 to 18% of Cr, 1.5 to 5% of Ni, and 0 to 3.25% of Mo as its base composition. Each steel is manufactured by an ordinary quenching and tempering method in which the steel is austenitized at a temperature of 950° to 1050° C., quenched in oil or air, and subsequently tempered at a temperature within the range between 550° and 720° C. There are numerous modifications of these steels having a similar chemical composition and similar heat treatment. Steels of all these known types are, however, highly susceptible to chloride stress corrosion cracking. When they are subjected to U-shape bending tests in 42%-$MgCl_2$ aqueous solutions, they usually experience crack formation within 100 hours.

As would be clearly understood from Examples given later, when the steels of the above-mentioned types were subjected to tests using 42%-$MgCl_2$ aqueous solutions after they had been quenched from their temperatures of 1000° to 1050° C. and then tempered at temperatures of 530° to 600° C., cracks were formed in all of the steels within 100 hours. However, if the steels, among these types of steels, each containing 16% or more of Cr, were quenched from its temperature of 680° to 830° C., and then optionally tempered at a temperature of less than 600° C., it was noted that no cracks were formed within the test period of two weeks. When the Cr content was about 15%, it was noted that the heat treatment still provided the improvement effect, though not so remarkably in its extent as that provided with the Cr content of 16% or more. No cracks were formed in steels of this type when tests were conducted using 30%-$MgCl_2$ aqueous solutions. When the Cr % in steel was further reduced, no appropriate range was observed to exist in heat-treatment temperature to improve the susceptibility to stress corrosion cracking. Therefore, if the Cr content is less than 15%, it is impossible to improve the susceptibility of this steel to stress corrosion cracking by altering the heat treatment.

Thus, in order that the heat treatment specified in this description could provide any favorable effect, it is essential that 15% or more of Cr is contained. This forms a feature of the present invention. The followings are considered to be the reasons why the susceptibility to stress corrosion cracking is improved: The heating of the steel at a temperature between the $Ac_1$ transformation point and the $Ac_3$ transformation point causes the formation of an austenite phase and a ferrite phase, and redistribution of composition occurs between these phases. The austenite phase transforms into a martensite phase during the quenching. Consequently, the steel is provided with a structure in which martensite and tempered martensite are mixed. At this point, it is essential that these phases are mixed at a proper mixture ratio, to ensure a remarkable improvement of the susceptibility to crack formation. In this respect, the thus provided effect is considered to be similar to that of duplex stainless steel in improving its susceptibility to stress corrosion cracking.

Next, the reasons why the steel is made to contain 2 to 6% of Ni and 15 to 18% of Cr in accordance with the present invention are given below. Cr acts to enlarge the $(\alpha+\gamma)$ temperature region in the Fe-Cr phase diagram, to thereby enlarge the temperature range that ensures the formation of the proper structure described above. Cr also acts to cause a suitable redistribution of the composition. FIG. 1 is a graph showing the relationship between the period before crack formation and the Cr content, obtained from tests conducted using 42%-$MgCl_2$ aqueous solutions for steels which each contain 2 to 3% of Ni, 0.3 to 0.5% of Mo, and a varying amount f Cr, and which each have been quenched at a temperature of 680° to 710° C. and tempered at a temperature of 530° to 540° C. As is clearly seen from FIG. 1, if the Cr content is 15% or more, the susceptibility to crack formation is greatly improved, whereas if the Cr content is less than 15%, this allows the heat treatment of the present invention to provide only a moderate effect of improving such susceptibility. Also, with a Cr content of less than 15%, although there do exist certain heat treatment conditions capable of preventing crack formation, the ranges of the conditions are extremely narrow and are therefore applicable only with difficulty. The upper limit of the Cr content is basically set to the upper limit with which the steel remains a martensitic stainless steel (this may partly contain delta-ferrite), and the upper limit varies in accordance with other components (e.g., C, Mn, Ni, and Mo). In general, however, with the Ni content being set between 2 and 6%, if the Cr content exceeds 18%, too much alpha-ferrite would be contained, thus causing the risk of the strength being reduced and making the control over the strength and toughness difficult. For these reasons, the upper limit of the Cr content is set at 18%. The above-stated effect provided by Cr is considered to be essentially related to its action of enlarging the $(\alpha+\gamma)$ temperature region in the Fe-Cr phase diagram, mentioned before. Since Mo can act similarly, it is well possible to substitute part of Cr by Mo. In this respect, the lower limit of the Cr content, stated before, should be specified in terms of a Cr equivalent value.

Ni in a martensitic stainless steel is an element which improves low-temperature toughness, strength and corrosion resistance. Simultaneously, it enhances the susceptibility to chloride stress corrosion cracking. If Cr is contained in an amount of 15% or more, 2% or more of Ni needs to be added to the steel in order that the steel remains a martensitic stainless steel. If the content of Ni is less than 2%, a large amount of delta-ferrite is formed, thus causing a reduction in strength and low-temperature toughness. On the other hand, if Ni is added by an amount exceeding 6%, the austenite phase increases to make the steel a austenitic-martensitic stainless steel, thereby causing a reduction in the strength and also increasing the susceptibility to crack formation. The structure of a martensitic stainless steel is usually affected by other elements such as C, Si, Mn, and Mo, as well as Cr and Ni. The method of the present invention uses a stainless steel which, while the Cr and Ni contents therein are limited to the above-specified ranges, possesses such a chemical composition that the steel remains a martensitic stainless steel, however large or small the contents of these other elements may be.

Figure 2:
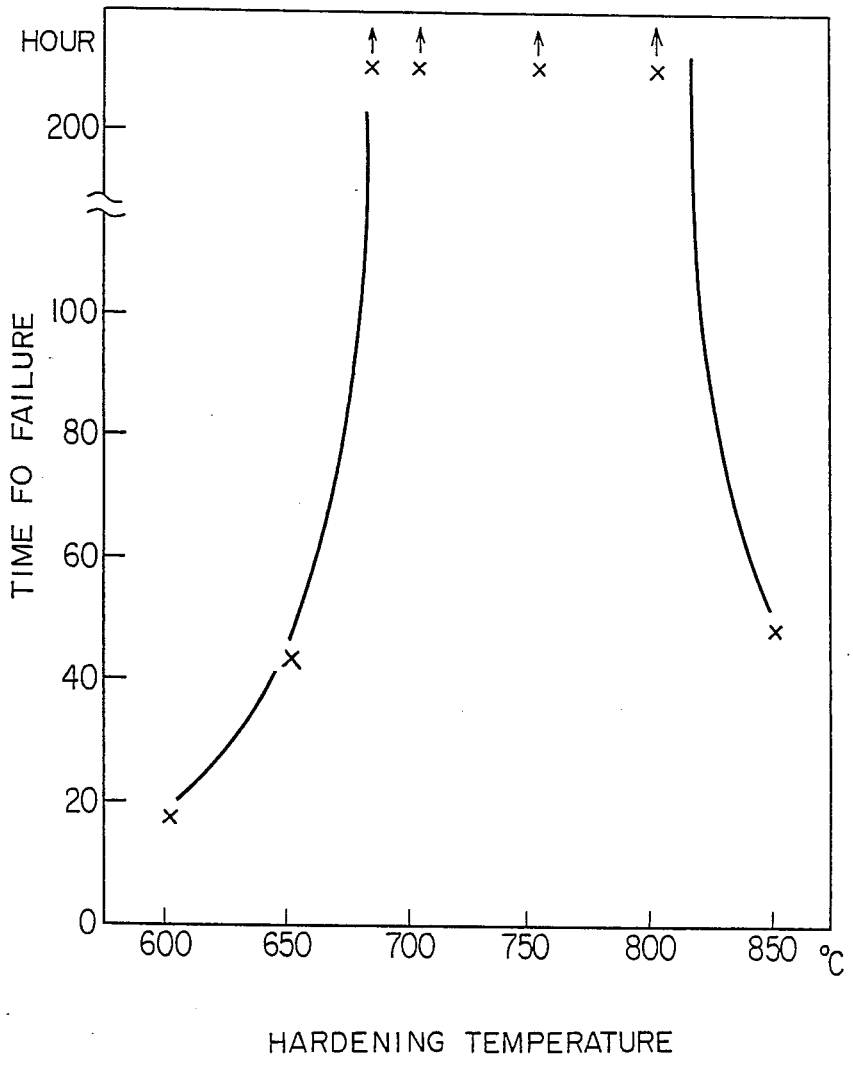
FIG. 2 is a graph showing the relationship between the time to failure and the quenching temperature, obtained from tests conducted using 42%-$MgCl_2$ aqueous solutions for a steel J shown in Table 1 which has been quenched from varying temperature of 600° to 850° C. and then tempered at 540° C.
Figure 3:
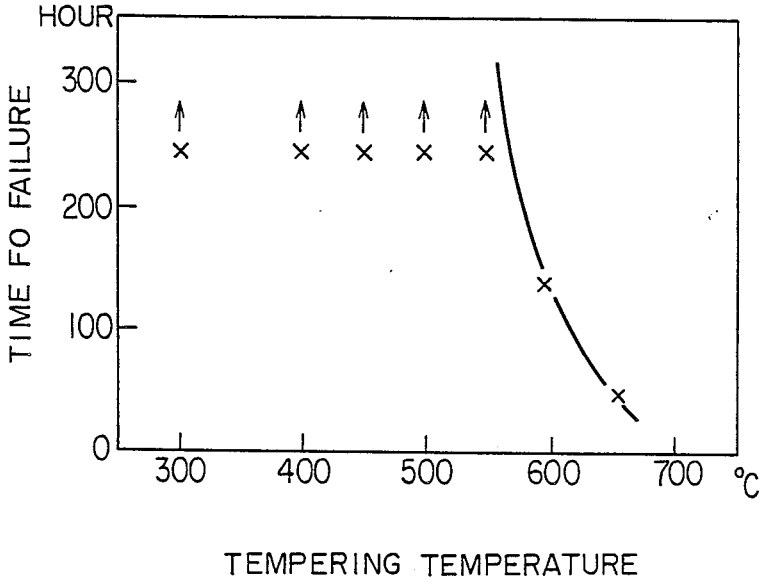
FIG. 3 is a graph showing the relationship between the time to failure and the tempering temperature, obtained from tests conducted using 42%-$MgCl_2$ aqueous solutions for the steel J. which has been quenched from its temperature of 750° C. and then tempered at a varying temperature.

Next, the reasons for specifying the heat treatment temperature of the method of the present invention will be described below. The feature of the present invention is that, in contrast with the prior art in which the steel is quenched from its austenitizing temperature, the steel is heated to a temperature of 680° to 830° C. which is a temperature between the transformation points $Ac_1$ and $Ac_3$, the steel is then maintained at that temperature, and it is thereafter quenched. That is, 25 to 75% in volume of austenite phase is formed at that quenching temperature and is then cooled, thereby forming a structure in which martensite and tempered martensite are mixed. FIG. 2 is a graph showing the period before crack formation in relation to quenching temperature, obtained from tests conducted using 42%-$MgCl_2$ aqueous solutions for a steel J shown in Table 1, explained later, which has been quenched from a varied temperature of 600° to 850° C. and then tempered at 540° C. It is clear from the graph that, if the quenching temperature is within the range between 680° to 830° C., the steel exhibits a good resistance to stress corrosion cracking. As will be seen from examples of steels F, G and J shown in Table 3, if a steel is quenched at a temperature within the above-mentioned range, the steel exhibits an excellent resistance to crack formation even if the steel is in the as-quenched condition. However, if the steel is in the as-quenched condition, it contains a large amount of martensite phase so that its low-temperature toughness and corrosion resistance are not necessarily very good. In an attempt to recover these characteristics of the steel by subjecting it to tempering treatment, however, if the tempering temperature is 600° C. or higher, the austenite phase is formed, thus destroying the proper structure which has been obtained by the quenching treatment, and again increasing the susceptibility to crack formation. This phenomenon will be clearly noted from FIG. 3 which is a graph showing the relationship between the time to failure and the tempering temperature, obtained from tests conducted using 42%-$MgCl_2$ aqueous solutions for the steel J which has been quenched at a temperature of 750° C. and then tempered. That is, if the quenching temperature within the above-mentioned range has been used, a tempering treatment using a temperature of less than 600° C. makes it possible to improve the low-temperature toughness and corrosion resistance without deteriorating the resistance to crack formation.

The present invention will be explained hereunder in detail by way of examples of the steels manufactured by the method of the present invention.

(EXAMPLES)

Certain examples of steels manufactured by the method of the present invention will be explained in comparison with the steels manufactured by conventional methods. Table 1 shows the chemical composition of sample steels A to L in weight percentage. The sample steels A, B, C, D, and E are those manufactured by the conventional methods (hereinafter abbreviated to "conventional steels"), whereas the sample steels F, G, H, I, J , K, and L are the steels manufactured by the method of the present invention (hereinafter abbreviated to "steels of the invention"). Table 2 shows the time to failure obtained by conducting tests using 30%-$MgCl_2$ aqueous solutions and 42%-$MgCl_2$ aqueous solutions for the steels shown in Table 1, which had been quenched by air-cooling from their austenitizing temperatures of 1000° to 1050° C., and then tempered at temperatures shown in Table 2 for four to six hours. In all the tests, U-shape bent test pieces were used. Since all the sample steels were quenched from temperatures which are out of the quenching temperature range of the present invention, not only the conventional steels A to E but also the steels F to L of the present invention experienced crack formation within relatively short periods. Table 3 shows the difference in susceptibility to crack formation between the cases where the steels F to L of the invention were subjected to the heat treatment of the present invention and the cases where the conventional steels A to D were subjected to the same heat treatment. The time to failure was obtained from tests using 30%-$MgCl_2$ aqueous solutions and 42%-$MgCl_2$ aqueous solutions as in the case shown in Table 2. As will be clearly seen from Table 3, the resistance to crack formation of the steels of the invention which were subjected to the heat treatment of the present invention is at an evidently higher level than that of the conventional steels. When the time to failure obtained in the 42%-$MgCl_2$ aqueous solution tests is compared, it is noted that steels H to L of the invention as well as steels F and G of the invention show remarkable improvement effects. Although the steels F and G of the invention were sometimes found to crack within periods of about 120 hours in the 42%-$MgCl_2$ aqueous solution tests, they proved the time to failure to be of at least 336 hours in the 30%-$MgCl_2$ aqueous solution tests. When these results are compared to the results shown in FIG. 2, the improving effects can be clearly noted. The results shown in Table 3 were obtained under the same conditions as in Table 2 with respect to the holding time of the heat treatment and the conditions of stress corrosion cracking test.

TABLE 1

| STEEL TYPE | COMPOSITION (%) | | | | | |
|---|---|---|---|---|---|---|
| | C | Si | Mn | Ni | Cr | Mo |
| A | 0.01 | 0.30 | 0.53 | 2.01 | 12.05 | 0.58 |
| B | 0.02 | 0.40 | 0.60 | 3.54 | 12.21 | 0.56 |
| C | 0.02 | 0.35 | 0.54 | 5.16 | 12.03 | 0.40 |
| D | 0.03 | 0.20 | 0.55 | 3.53 | 14.14 | 0.60 |
| E | 0.04 | 0.25 | 0.52 | 5.06 | 13.85 | 0.57 |
| F | 0.02 | 0.29 | 0.83 | 2.98 | 15.48 | 0.38 |
| G | 0.04 | 0.02 | 0.86 | 4.08 | 15.52 | 0.21 |
| H | 0.02 | 0.30 | 0.53 | 3.55 | 16.61 | 0.56 |
| I | 0.03 | 0.32 | 0.47 | 5.12 | 16.53 | 0.37 |
| J | 0.03 | 0.29 | 0.46 | 3.00 | 17.05 | 0.20 |
| K | 0.01 | 0.01 | 0.42 | 4.00 | 17.46 | 0.20 |
| L | 0.02 | 0.01 | 0.43 | 3.98 | 17.45 | 0.56 |

TABLE 2

| STEEL TYPE | TEMPERING TEMPERATURE (°C.) | TIME TO FAILURE (hour) | |
|---|---|---|---|
| | | 30%-$MgCl_2$ AQUEOUS SOLUTION | 42%-$MgCl_2$ AQUEOUS SOLUTION |
| A | 530 | — | 88 |
| B | 560 | 72 | 16 |
| C | 600 | 48 | 16 |
| D | 600 | 72 | 16 |
| E | 600 | 48 | 16 |
| F | 540 | 72 | 24 |
| F | 560 | 72 | 22 |
| F | 580 | 86 | 48 |
| G | 600 | 100 | 22 |
| H | 600 | — | 16 |
| I | 600 | — | 16 |
| J | 560 | — | 24 |
| J | 580 | — | 22 |
| J | 600 | — | 48 |
| K | 600 | — | 22 |
| L | 600 | — | 22 |

TABLE 3

| CATEGORY STEEL TYPE | QUENCHING TEMP. (°C.) | TEMPERING TEMP. (°C.) | TIME TO FAILURE (hour) | |
|---|---|---|---|---|
| | | | 30%-$MgCl_2$ AQUEOUS SOLUTION | 42%-$MgCl_2$ AQUEOUS SOLUTION |
| METHOD OF THE PRESENT INVENTION | | | | |
| F | 680 | 540 | 336 | 118 |
| | 710 | 540 | 336 | 142 |
| | 700 | — | 336 | 336 |
| G | 680 | 540 | 336 | 118 |
| | 700 | — | 336 | 336 |
| H | 710 | 540 | — | 336 |

TABLE 3-continued

| CATEGORY STEEL TYPE | QUENCHING TEMP. (°C.) | TEMPERING TEMP. (°C.) | TIME TO FAILURE (hour) 30%-$MgCl_2$ AQUEOUS SOLUTION | 42%-$MgCl_2$ AQUEOUS SOLUTION |
|---|---|---|---|---|
| I | 690 | 540 | — | 336 |
| J | 700 | 540 | — | 240 |
| | 700 | — | — | 240 |
| | 750 | 540 | — | 240 |
| | 750 | — | — | 240 |
| | 800 | 540 | — | 240 |
| K | 680 | 540 | — | 240 |
| L | 680 | 540 | — | 240 |
| | 710 | 540 | — | 240 |
| COMPARISON | | | | |
| A | 770 | 520 | — | 96 |
| B | 720 | 530 | — | 16 |
| C | 700 | 530 | — | 19 |
| D | 690 | 540 | — | 19 |

INDUSTRIAL APPLICABILITY

As has been explained above, the present invention provides a method of manufacturing a Cr—Ni martensitic stainless steel which is adapted to prepare a steel containing specified amounts of Cr and Ni and to subject the steel to heat treatment at a specified suitable temperature, and the method is thus capable of manufacturing the Cr—Ni martensitic stainless steel which is excellent in resistance to chloride stress corrosion cracking, has a high level of low-temperature toughness, and allows the adjustment of its strength within a wide range. A stainless steel manufactured by this method can be applied to the equipment, for instance, valves or petroleum drilling equipment, in which the resistance to stress corrosion cracking and low-temperature toughness are required.

What is claimed is:

1. A method for manufacturing a martensitic stainless steel having excellent resistance to stress corrosion cracking, consisting of:

preparing a steel containing 2–6% by weight of nickel and 15–18% by weight of chromium;

heating said steel homogeneously to a temperature between the $Ac_1$ point and the $Ac_3$ point of the steel; and cooling said steel, wherein, in said heating step, from 25–75 volume percent of the steel is converted to the austenite phase, and upon cooling thereof, a mixed structure of martensite and tempered martensite is formed.

2. The method of claim 1, wherein the heating of said steel is conducted such that the temperature falls within the range of 680–830° C., which ranges between said $AC_1$ point and said $Ac_3$ point.

3. A method for manufacturing martensitic stainless steel having excellent resistance to stress corrosion cracking, consisting of:

preparing a steel containing 2–6% by weight of nickel and 15–18% by weight chromium;

heating said steel homogeneously at a temperature between the $Ac_1$ point and the $AC_3$ point and thereafter cooling said steel, wherein, in said heating step, from 25–75 volume percent of the steel is converted to the austenite phase, and upon cooling thereof, a mixed structure of martensite and tempered martensite is formed; and tempering said steel at a temperature below 600° C.

* * * * *